US008882349B2

(12) United States Patent
Blythe

(10) Patent No.: US 8,882,349 B2
(45) Date of Patent: Nov. 11, 2014

(54) END STOPS FOR RECLOSABLE FASTENER AND RECLOSABLE BAG HAVING SAME

(71) Applicant: Reynolds Consumer Products, Lake Forest, IL (US)

(72) Inventor: James S. Blythe, Libertyville, IL (US)

(73) Assignee: Reynolds Consumer Products Inc., Lake Forest, IL (US)

( * ) Notice: Subject to any disclaimer, the term of this patent is extended or adjusted under 35 U.S.C. 154(b) by 28 days.

(21) Appl. No.: 13/839,044

(22) Filed: Mar. 15, 2013

(65) Prior Publication Data

US 2014/0270588 A1 Sep. 18, 2014

(51) Int. Cl.

| | |
|---|---|
| ***B65D 33/16*** | (2006.01) |
| ***A44B 1/04*** | (2006.01) |
| ***A44B 19/10*** | (2006.01) |
| ***B65D 33/25*** | (2006.01) |

(52) U.S. Cl.

CPC ..... *B65D 33/2591* (2013.01); *A44B 19/10* (2013.01)

USPC ..... 383/64; 24/436

(58) Field of Classification Search

CPC .... B65D 33/2591; A44B 19/36; A44B 19/16; A44B 19/267

USPC ..... 383/64–65; 24/436, 399, 400

See application file for complete search history.

(56) References Cited

U.S. PATENT DOCUMENTS

| | | | |
|---|---|---|---|
| 5,007,143 | A | 4/1991 | Herrington |
| 7,267,856 | B2 | 9/2007 | Patel et al. |
| 7,669,307 | B2 | 3/2010 | Patel et al. |
| 8,087,826 | B1 | 1/2012 | Blythe et al. |

OTHER PUBLICATIONS

U.S. Appl. No. 13/839,496, filed Mar. 15, 2013.
U.S. Appl. No. 13/841,054, filed Mar. 15, 2013.

*Primary Examiner* — Jes F Pascua
(74) *Attorney, Agent, or Firm* — Baker Botts LLP

(57) ABSTRACT

Reclosable fastener assembly includes a fastener comprising a pair of interlocking tracks including a first track having a male profile and a second track having a female profile, the fastener having a height and a width when the tracks are interlocked, a slider slidably mounted to the tracks for movement between a closed position and an open position, and at least one end stop located at an end of the fastener, the end stop formed integrally from at least one of the first and second tracks, the end stop having a wedge shape with a first end, a second end, and a lateral extent, the first end being proximate the fastener and having a height no greater than the height of the fastener, the end stop having a decreasing height from the first end to the second end, and the lateral extent extending beyond the width of the fastener.

22 Claims, 3 Drawing Sheets

END STOPS FOR RECLOSABLE FASTENER AND RECLOSABLE BAG HAVING SAME

BACKGROUND OF THE INVENTION

1. Field of the Invention

The disclosed subject matter generally relates to reclosable fasteners with sliders particularly suited for thermoplastic bags and the like. Particularly, the disclosed subject matter relates to a track and slider configuration with increased strength and flexibility and reduced size.

2. Description of Related Art

Plastic bags are in widespread use in a varied and diverse number of household and commercial applications, especially in the food packaging industry. One advantage of plastic bags is their ease of opening and resealing. Some of these bags are reclosable via the use of a reclosable feature such as a reclosable fastener. In many bags, the fasteners can be opened and closed either by pressure or by the use of an auxiliary slider mechanism.

Generally, two types of such reclosable fasteners exist—(i) push to close ("PTC") and (ii) zipper. The PTC fastener requires the application of an external force to open or close the engageable tracks, whereas the zipper fastener relies upon a slider for opening or closing the rib and groove elements. As such, the profile configuration of the reclosable track of a zipper fastener often differs from that of a PTC fastener.

In the manufacture of thermoplastic film bags, a pair of male and female fastener elements or tracks extend along the mouth of the bag and these male and female elements are adapted to be secured in any suitable manner to the flexible walls of the thermoplastic film bag. These elements may be integral marginal portions of such walls or the elements may be extruded separately and thereafter attached to the walls along the mouth of the bag. U.S. Pat. Nos. 5,007,143 and 8,087,826, each of which is incorporated by reference in its entirety, describe one type of zipper profile in which the cross-sectional shape of the zipper is such that the male and female elements can be engaged or closed by pressing the bottom together first, then rolling it closed toward the top. This configuration is referred to as a "rolling action" reclosable fastener.

Furthermore, various arrangements have been utilized heretofore to maintain auxiliary slider mechanisms on fasteners. One arrangement which has been used to prevent or inhibit the slider mechanism from going past the ends of the fastener and coming off of the bag is to incorporate opposing end termination clips at the ends of the fastener. The use of end termination clips, however, increases the cost of producing the bag as it requires an additional component on the bag and an additional piece of equipment in order to place the end termination clips on the bag. In addition, the placement of end termination clips on the ends of the fastener involves an additional processing step which may not be desirable when manufacturing speeds are important.

To avoid using end termination clips to prevent or inhibit the auxiliary slider mechanism from going past ends of the fastener, an alternative arrangement has been employed which involves shaping material from the fastener into opposing end stops or end stop structures which protrude from the fastener or zipper and engage the slider mechanism to prevent or inhibit it from going past the respective ends of the fastener. U.S. Pat. Nos. 7,267,856 and 7,669,307, each of which is incorporated by reference in its entirety, describe one technique to shape end stop structures by ultrasonically smashing the opposite ends of the male and female profiles of the fastener to form the protruding end stop structures.

However, there remains an opportunity to improve the seal strength of such conventional fasteners, yet provide a fastener with increased flexibility, for example to permit the fasteners to be easily opened and closed on overstuffed bags. Additionally, there remains an opportunity to provide a fastener with reduced size that can be formed using less material than conventional fasteners.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a reclosable fastener assembly including a fastener having a pair of interlocking plastic tracks including a first track having a male profile and a second track having a female profile. The fastener has a height and a width when the first track and the second track are interlocked. The fastener assembly includes a slider slidably mounted to the pair of plastic tracks for movement between a closed position and an open position. The fastener assembly further includes at least one end stop located at an end of the fastener, the at least one end stop formed integrally from at least one of the first track and the second track. The end stop has a wedge shape with a first end, a second end, and a lateral extent, the first end being proximate the fastener and having a height no greater than the height of the fastener. The end stop has a decreasing height from the first end to the second end, and the lateral extent extending beyond the width of the fastener.

As embodied herein, the at least one end stop can include a first end stop formed integrally from the first track and a second end stop formed integrally from the second track. The first end stop and the second end stop can be free of a bond therebetween. Alternatively, the first end stop and the second end stop can be bonded together.

In some embodiments, the at least one end stop can include a single end stop formed integrally from both the first track and the second track. The height of the first end of the end stop can be less than the height of the fastener.

Furthermore, and as embodied herein, the pair of interlocking plastic tracks can define an axis, and the lateral extent can form an angle up to about 15 degrees relative to the axis. The pair of interlocking tracks can define an axis, and the end stop can have an upper surface angled relative to the axis.

In some embodiments, the end stop can be formed by at least one of ultrasonic welding, cold forming, thermal forming and injection molding. The end stop can include at least one of high density polyethylene, cyclic olefin copolymer, and low density polyethylene.

According to another aspect of the disclosed subject matter, a reclosable bag includes first and second opposing body panels fixedly connected to each other along a pair of sides and a bottom bridging the pair of sides and a reclosable fastener assembly extending along a mouth formed opposite the bottom. The reclosable fastener assembly includes a fastener comprising a pair of interlocking plastic tracks including a first track having a male profile and a second track having a female profile. The fastener has a height and a width when the first track and the second track are interlocked. The fastener assembly includes a slider slidably mounted to the pair of plastic tracks for movement between a closed position and an open position. The fastener assembly further includes at least one end stop located at an end of the fastener, the at least one end stop formed integrally from at least one of the first track and the second track. The end stop has a wedge shape with a first end, a second end, and a lateral extent, the first end being proximate the fastener and having a height no greater than the height of the fastener. The end stop has a decreasing height from the first end to the second end, and the lateral extent extending beyond the width of the fastener.

As embodied herein, the at least one end stop can include a first end stop formed integrally from the first track and a second end stop formed integrally from the second track. The first end stop and the second end stop can be free of a bond therebetween. Alternatively, the first end stop and the second end stop can be bonded together.

In some embodiments, the at least one end stop can include a single end stop formed integrally from both the first track and the second track. The height of the first end of the end stop can be less than the height of the fastener.

Furthermore, and as embodied herein, the pair of interlocking plastic tracks can define an axis, and the lateral extent can form an angle up to about 15 degrees relative to the axis. The pair of interlocking tracks can define an axis, and the end stop can have an upper surface angled relative to the axis.

In some embodiments, the end stop can be formed by at least one of ultrasonic welding, cold forming, thermal forming and injection molding. The end stop can include at least one of high density polyethylene, cyclic olefin copolymer, and low density polyethylene.

According to another aspect of the disclosed subject matter, a method of making a reclosable fastener assembly includes providing a fastener having a pair of interlocking plastic tracks including a first track having a male profile and a second track having a female profile, the fastener having a height and a width when the first track and the second track are interlocked. The method further includes slidably mounting a slider to the pair of plastic tracks for movement between a closed position and an open position. The method can further include forming at least one end stop at an end of the fastener, the at least one end stop formed integrally from at least one of the first track and the second track, the at least one end stop having a wedge shape with a first end, a second end, and a lateral extent, the first end being proximate the fastener and having a height no greater than the height of the fastener, the at least one end stop having a decreasing height from the first end to the second end, and the lateral extent extending beyond the width of the fastener.

In some embodiments, the method can further include forming a further end stop from the at least one of the first track and the second track, the further end stop formed in line with and proximate to the at least one end stop, and separating the at least one end stop from the further end stop. In this manner, the further end stop forms an end stop of a similarly configured but separate fastener.

DETAILED DESCRIPTION OF THE PREFERRED EMBODIMENT

Reference will now be made in detail to the present preferred embodiments of the application, examples of which are illustrated in the accompanying drawings. The reclosable fasteners and assemblies presented herein generally are intended for thermoplastic bags, although other similar or suitable uses are contemplated. In accordance with the disclosed subject matter, a reclosable fastener assembly is provided. The reclosable fastener assembly includes a fastener comprising a pair of interlocking plastic tracks including a first track having a male profile and a second track having a female profile. The fastener has a height and a width when the first track and the second track are interlocked. At least one end stop is located at an end of the fastener, the at least one end stop formed integrally from at least one of the first track and the second track. The end stop has a wedge shape with a first end, a second end, and a lateral extent, the first end being proximate the fastener and having a height no greater than the height of the fastener. The end stop has a decreasing height from the first end to the second end, and the lateral extent extending beyond the width of the fastener. The assembly further includes a slider slidably mounted to the pair of plastic tracks for movement between a closed position and an open position.

Figure 2:
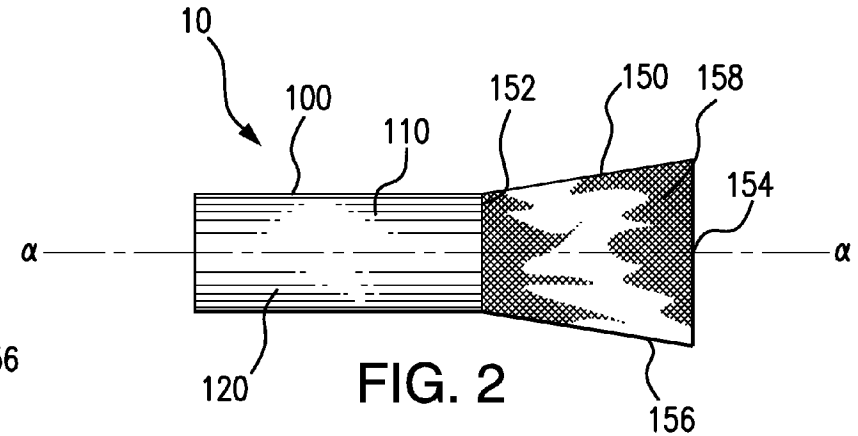
FIG. 2 is a top view of the portion of the reclosable fastener of FIG. 1.
Figure 3:
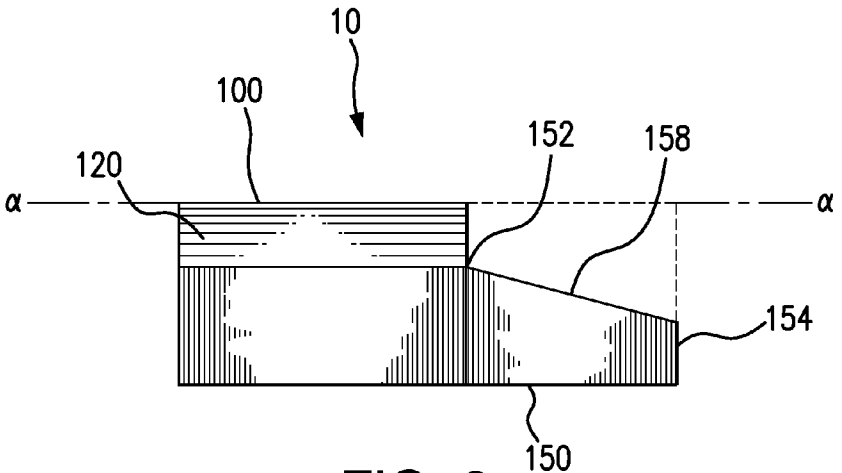
FIG. 3 is a side view of the portion of the reclosable fastener of FIG. 1.
Figure 1:
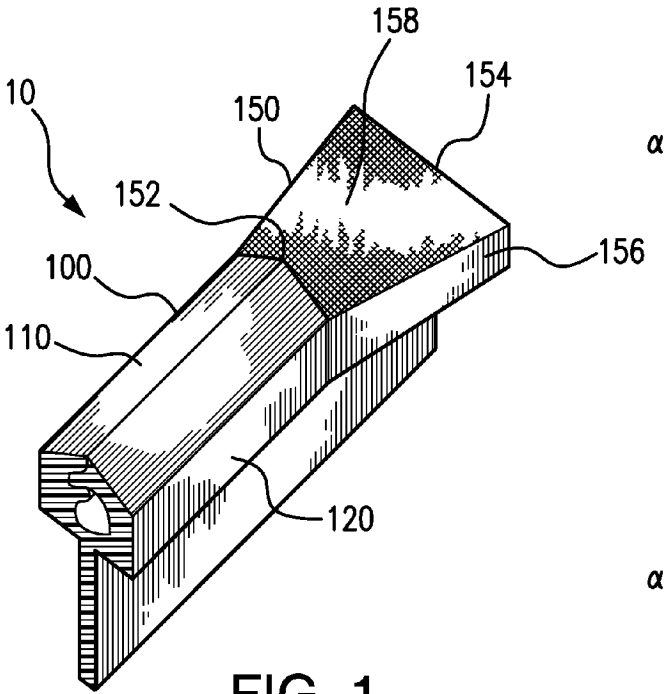
FIG. 1 is a perspective view of a portion of an exemplary reclosable fastener illustrating an exemplary end stop according to the disclosed subject matter.

For purpose of explanation and illustration, and not limitation, a representative embodiment of a reclosable fastener in accordance with the application is shown in FIGS. 1-3 and is designated generally by reference character 100.

With reference to FIG. 1, the fastener 100 includes a first track 110, a second track 120. The first track 110 can include a first engagement profile, which can be configured, for example and without limitation, as a male engagement profile, and as such can include a rib or other projection. The second track 120 can include a second engagement profile, which can be configured, for example and without limitation, as a female engagement profile, and as such can include a notch or other opening to receive the projection of the first engagement profile and one or more flanges to engage the first engagement profile. As shown for example in FIGS. 1-3, the first track 110 and can second track 120 define a height and a width of the fastener 100 and an axis $\alpha$ when the first and second tracks 110, 120 are interlocked.

A slider 130 (as shown, for example, in FIGS. 4-5 and 7) can be positioned on the first track 110 and second track 120 to matingly engage the first and second tracks 110, 120 when moved along the first and second tracks 110, 120 from an open position toward a closed position. Likewise, slider 130 is configured to disengage the first and second tracks 110, 120 when moved along the first and second tracks 110, 120 from a closed position to an open position. A variety of suitable sliders can be used, based on the profiles of the interlocking tracks. For purpose of illustration and not limitation, further details of suitable sliders for use with interlocking first and second tracks are described in U.S. Pat. Nos. 5,007,143; 7,114,310; 7,159,282; 7,178,309; 7,263,748; 7,267,856;

7,341,160; 7,377,015; 7,549,954; 7,665,192; 7,669,307; 7,946,004; and 8,087,826, each of which is incorporated by reference in its entirety.

In accordance with the disclosed subject matter, and as shown in FIGS. 1-3, fastener assembly 10 includes an end stop 150 formed at an end of fastener 100. End stop 150 is formed integrally from at least one of the first track 110 and the second track 120. For example and as embodied herein, a single end stop 150 can be formed integrally from both the first track 110 and the second track 120. In this manner, a portion of end stop 150 can be formed integrally from each of the first track 110 and the second track 120, and the portions can be bonded together to form end stop 150. Alternatively, a single end stop 150 can be formed at the end of one of the two tracks 110, 120, or a separate end stop can be formed at the end of each track 110, 120, respectively, as described further below. Similarly, the assembly 10 can include another end stop 150 formed at an opposite end of fastener 100, as shown for example in FIG. 7.

As depicted in FIGS. 1-3, end stop 150 can include a first end 152 proximate the fastener 100, and a second end 154 opposite the first end 152. For example, if the end stop 150 is made integrally from the first and/or second track 110, 120, the first end 152 of the end stop 150 can be disposed proximate to the termination of the profile for the corresponding track. End stop 150 also includes a lateral extent 156, which can have a width increasing from the first end 152 to the second end 154. The lateral extent 156 of the end stop 150 extends beyond the width of fastener 100 defined by the first and second tracks 110, 120 when the first and second tracks 110, 120 are interlocked. As such, and as embodied herein, end stop 150 can have a wedge shape. In certain embodiments, the wedge shape can define an angle up to about 15 degrees relative to the axis $\alpha$ formed by the first and second tracks 110, 120. Thus, lateral extent 156 of end stop 150 can protrude from fastener 100 a distance adequate to engage the slider 130 and prevent the slider 130 from being moved beyond the respective end of the fastener 100 and thus becoming disengaged from the fastener 100. In some embodiments, lateral extent 156 of end stop 150 at a widest point can be up to 200% (e.g., about 0.20 inches) the width of the fastener 100 when the first and second tracks 110, 120 are interlocked, and particularly between about 170% to 200% of such width.

End stop 150 can be formed by compressing an end portion of first track 110 and/or second track 120 to spread the material of the track laterally to form the lateral extent 156. In this manner, the height of at least a portion of end stop 150 is less than the initially undeformed or compressed portion of the first and second tracks 110, 120. As such, end stop 150 will have a height no greater than the height of fastener 100 defined by the first and second tracks 110, 120, and at least a portion of the end stop 150 will have a height less than the height of the fastener 100. In some embodiments, end stop 150 in its entirety can have a height less than the height of fastener 100. Furthermore, end stop 150 can have a height that varies along its length, such as decreasing from first end 152 to second end 154, as depicted in FIG. 3. For example, end stop 150 can be formed having an upper surface 158, which can define an angle relative to axis $\alpha$ formed by first and second tracks 110, 120. In some embodiments, the angle formed by upper surface 158 can be within a range of which can be up to about 10 to 15 degrees relative to axis $\alpha$. In this manner, the end stop 150 will have an increasing width or lateral extent 156 from first end 152 to second end 154, with a decreasing height. Other suitable configurations also can be used.

Figure 5:
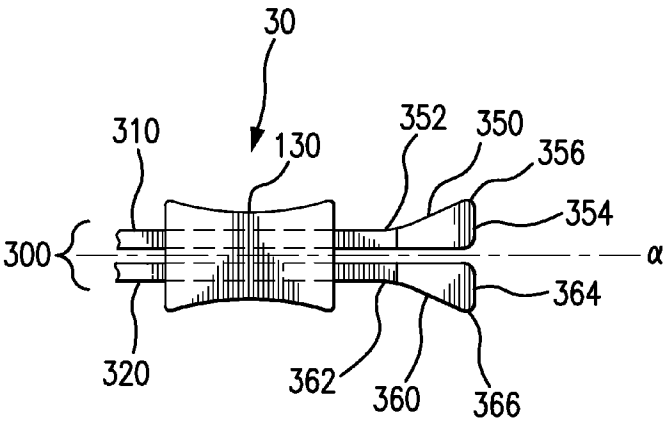
FIG. 5 is a top view of the portion of the reclosable fastener of FIG. 4.
Figure 4:
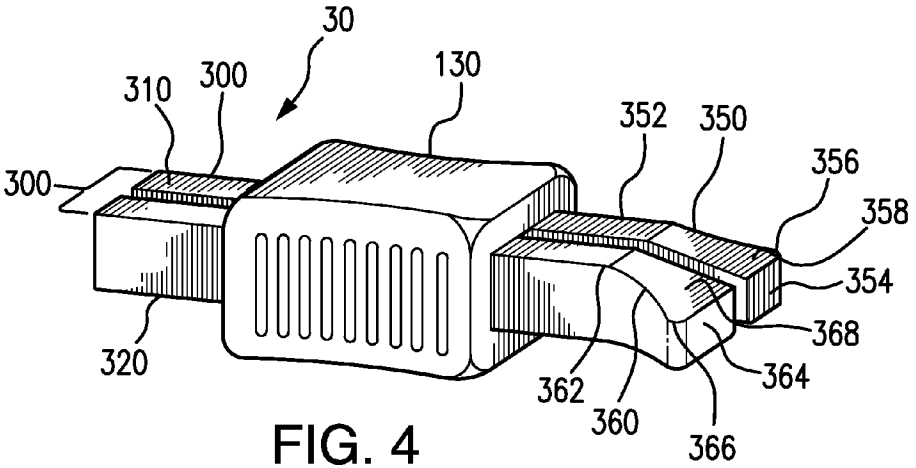
FIG. 4 is a perspective view of a portion of another exemplary embodiment of a reclosable fastener illustrating another exemplary end stop according to the disclosed subject matter.

FIGS. 4-5 illustrate another exemplary embodiment of a reclosable fastener assembly 30 having another exemplary end stop configuration. With reference to FIGS. 4-5, assembly 30 includes a fastener 300 having a first track 310, a second track 320. The first track 310 can include a first engagement profile, which can be configured, for example and without limitation, as a male engagement profile, and as such can include a rib or other projection. The second track 320 can include a second engagement profile, which can be configured, for example and without limitation, as a female engagement profile, and as such can include a notch or other opening to receive the projection of the first engagement profile and one or more flanges to engage the first engagement profile. The first track 310 and second track 320 define a height and a width of the fastener 300 and an axis $\alpha$ when the first and second tracks 310, 320 are interlocked.

As with the embodiment of FIG. 1-3, a slider 130 can be positioned on the first track 310 and second track 320 to matingly engage the first and second tracks 310, 320 when moved along the first and second tracks 310, 320 from an open position toward a closed position. Likewise, slider 130 can disengage the first and second tracks 310, 320 when moved along the first and second tracks 310, 320 from a closed position to an open position.

As shown in FIGS. 4-5, a first end stop 350 and a second end stop 360 are formed at an end of fastener 300. For example, and as embodied herein, the first end stop 350 is formed integrally from the first track 310 and the second end stop 360 is formed integrally from the second track 320. Furthermore, and as embodied herein, end stops 350, 360 can be formed free of a bond therebetween. End stop 350 can include a first end 352 proximate the fastener 300 and a second end 354 opposite the first end 352, and end stop 360 can include a first end 362 proximate the fastener 300 and a second end 364 opposite the second end 362. Fastener 300 likewise can include additional end stops 350, 360 formed at an opposite end of fastener 300.

Each end stop 350, 360 has a lateral extent 356, 366 extending beyond the width of fastener 300 defined by the first and second tracks 310, 320 when the first and second tracks 310, 320 are interlocked. As shown, for purpose of illustration, each end stops 350, 360 includes a lateral extent 356, 366, of increasing width from the first end 352, 362 to the second end 354, 364. As such, each end stop 350, 360 has a wedge shape, which can define an angle up to about 15 degrees relative to the axis $\alpha$ formed by the first and second tracks 310, 320. Thus, lateral extents 356, 366 of end stops 350, 360 can protrude from fastener 300 a distance adequate to engage the slider 130 and prevent the slider 330 from being moved beyond the respective ends of the fastener 300 and thus becoming disengaged from the fastener 300. In some embodiments, each lateral extent 356, 366 of end stops 350, 360 at a widest point can be up to 200% (e.g., about 0.20 inches) the width of the fastener 300 when the first and second tracks 310, 320 are interlocked, and particularly between about 170% to 200% of such width.

Furthermore, and as embodied herein, the wedge geometry of end stops 350, 360 can eliminate the need to bond end stops 350, 360 together. Rather, the movement of slider 130 proximate lateral extents 356, 366 of end stops 350, 360 urges end stops 350, 360 toward each other due to the wedge geometry of the lateral extents 356, 366.

End stops 350, 360 can be formed by compressing an end portion of first track 310 and second track 320 to spread the material of the track laterally to form the lateral extents 356, 366. In this manner, the height of at least a portion of end stops 350, 360 is less than the initially undeformed or compressed portion of the first and second tracks 310, 320. As such, end stops 350, 360 each will have a height no greater than the height of fastener 300 defined by the first and second tracks 310, 320, and at least a portion of the end stops 350, 360 can have a height less than the height of the fastener 300. In some embodiments, end stops 350, 360 each in its entirety can have a height less than the height of fastener 300. Furthermore, end stops 350, 360 each can have a height that varies along its length, such as decreasing from first ends 352, 362 to second ends 354, 364, respectively. For example, end stops 350, 360 can each be formed having an upper surface 358, 368 which can define an angle relative to axis α formed by first and second tracks 310, 320. In some embodiments, the angle formed by upper surface 358, 368 can be within a range of which can be up to about 0 to 15 degrees relative to axis α. In this manner, each end stop 350, 360 will have an increasing width or lateral extent 356, 366 from first end 352, 362 to second end 354, 364 with a decreasing height.

In accordance with another aspect of the disclosed subject matter, a method of making a reclosable fastener assembly is provided. The method includes providing a fastener comprising a pair of interlocking plastic tracks including a first track having a male profile and a second track having a female profile, the fastener having a height and a width when the first track and the second track are interlocked. The method further includes forming at least one end stop at an end of the fastener, the at least one end stop formed integrally from at least one of the first track and the second track, the at least one end stop having a wedge shape with a first end, a second end, and a lateral extent, the first end being proximate the fastener and having a height no greater than the height of the fastener, the at least one end stop having a decreasing height from the first end to the second end, and the lateral extent extending beyond the width of the fastener. The method can further include slidably mounting a slider to the pair of plastic tracks for movement between a closed position and an open position.

For purpose of illustration, reference is made to fastener assembly 10 of FIGS. 1-3, although the fastener assembly 30 of FIGS. 4-5 can be similarly formed. The shape of the end stop 150 can be formed by compressing material at an end portion of fastener 100 proximate first and second tracks 110, 120. Forming of the end stop 150 can be performed, for example and without limitation, by ultrasonic welding, cold forming, thermal forming or injection molding. Furthermore, cold molding can be performed to achieve a desired shape, for example by confining the end stop 150 within a mold to achieve the desired shape. As embodied herein, no new material is added to the fastener 100 to form end stop 150, but rather, material is redistributed from the upper portion of fastener 100 at the end portion of fastener 100 to form the shape of end stop 150.

Figure 6:
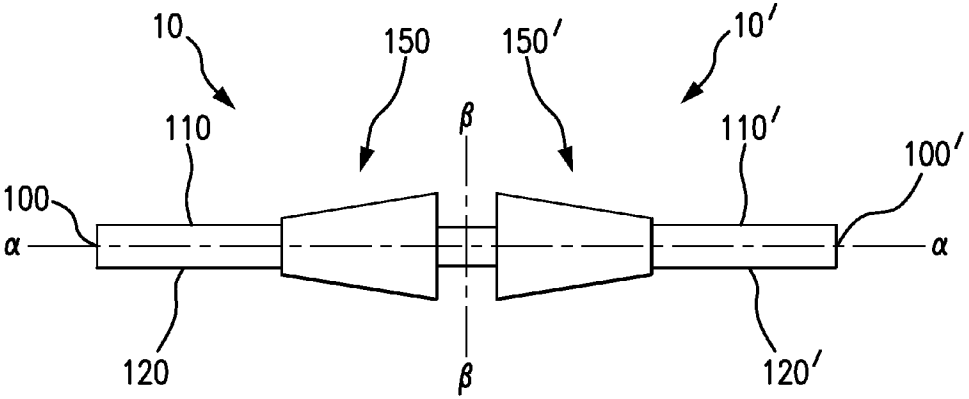
FIG. 6 is a top view illustrating a further end stop formed in line with and proximate the end stop of FIG. 1.

Additionally, as illustrated in FIG. 6, fasteners 100 and end stops 150 can be formed in an inline configuration. For example, a fastener 100 with end stop 150 can be formed inline with and proximate to a further, similarly configured end stop 150' of opposite orientation for a further fastener 100'. Fastener 100' and end stop 150' are thus separated from fastener 100 and end stop 150, for example by cutting fasteners 100, 100' along line β.

First and second tracks 110, 120 and consequently the end stops 150 formed therefrom can include combinations of one or more of high density polyethylene, medium density polyethylene, polypropylene, a cyclic olefin copolymer, a high density material, or a high modulus material. As such, the end stops 150 of fastener 100 can be formed of high density polyethylene (HDPE), medium density polyethylene (MDPE), polypropylene (PP), a cyclic olefin copolymer (COC), a high density material, a high modulus material, and combinations or copolymers thereof.

Figure 7:
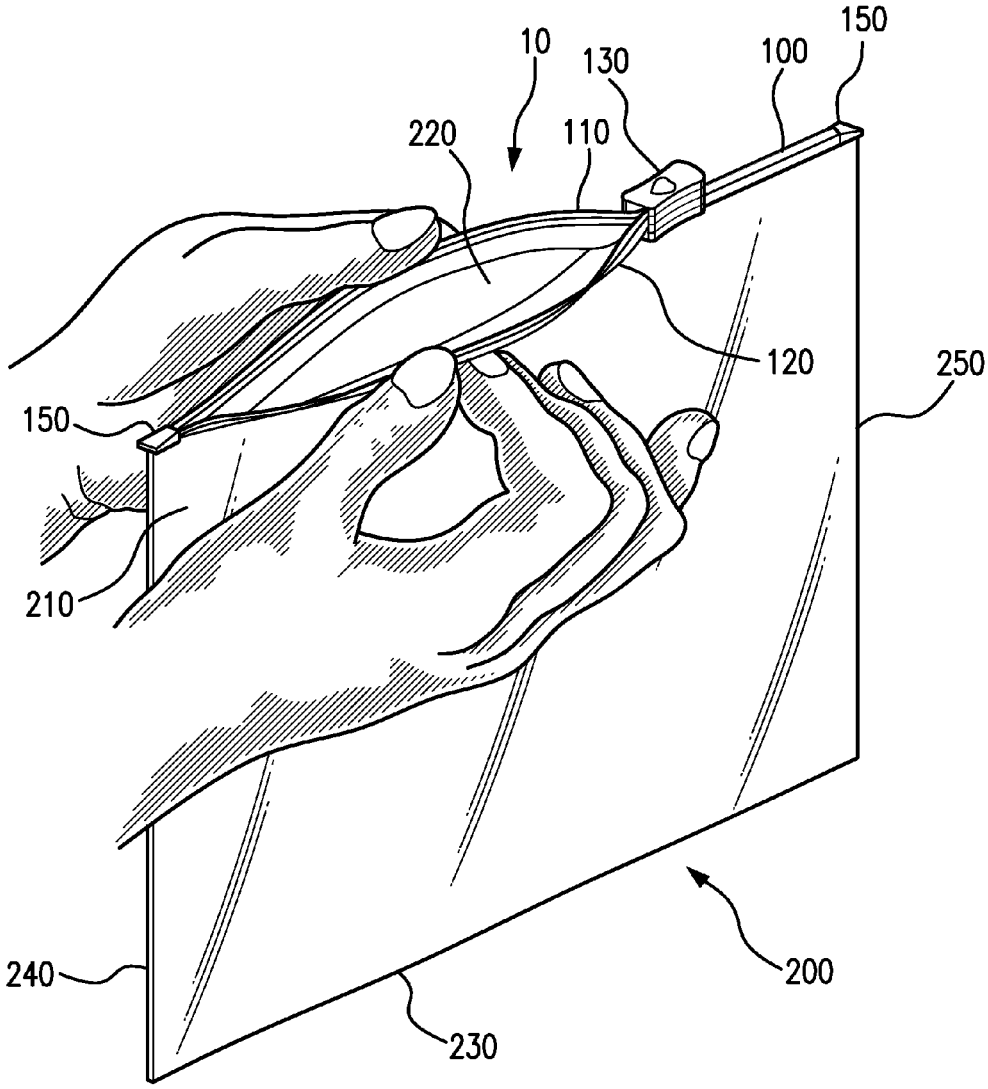
FIG. 7 is a perspective view of a portion of reclosable bag according to the disclosed subject matter.

For purpose of explanation and illustration, and not limitation, FIG. 7 shows an exemplary embodiment of a reclosable bag 200 having fastener assembly 10 of the disclosed subject matter. As depicted, the reclosable bag 200 includes first and second panels 210 and 220 each having a top, a bottom, and first and second opposing sides and reclosable fastener 100. The first and second panels 210, 220 are joined to each other along respective bottoms 230 and first and second opposing sides 240, 250. A mouth is defined between the first and second opposing sides 240, 250 and opposite the bottom 230. The bag 200 can be made from any suitable thermoplastic film such for example as polyethylene or polypropylene or other suitable materials known in the art.

The reclosable fastener assembly 10 is disposed along the mouth. As previously described, the reclosable fastener assembly 10 comprises first and second tracks 110, 120, which can be extruded separately and attached to the respective sides of the bag mouth, or alternatively, the first and second tracks 110, 120 can be extruded integral with the sides of the bag mouth. Slider 130 is shown in FIG. 7 assembled on the fastener 100 at the top edge or mouth of a thermoplastic bag 200.

The reclosable fastener 100 can have any suitable combination of the features described above. For example, the fastener 100 can include first and second tracks 110, 120 extending along the length of the top of the first and second opposing sides 210 and 220 with a single end stop 150 formed at each of the opposing ends of first and second tracks 110, 120, as described with regard to FIGS. 1-3. Alternatively, separate end stops can be formed at one or both ends of each track as described with regard to FIGS. 4-5. Furthermore, additional variations of the track and/or slider can be incorporated for use with the end stops of the disclosed subject matter. For example and without limitation, further details of exemplary fasteners including interlocking first and second tracks and a slider are described in the concurrently filed applications of James S. Blythe, entitled "RECLOSABLE FASTENER AND RECLOSABLE BAG HAVING SAME," Ser. No. 13/839,496 filed Mar. 15, 2013, and "VERTICAL ACTION RECLOSABLE FASTENER AND RECLOSABLE BAG HAVING SAME," Ser. No. 13/841,054 filed Mar. 15, 2013, each of which is incorporated by reference in its entirety.

While the present application is described herein in terms of certain preferred embodiments, those skilled in the art will recognize that various modifications and improvements may be made to the application without departing from the scope thereof. Thus, it is intended that the present application include modifications and variations that are within the scope of the appended claims and their equivalents. Moreover, although individual features of one embodiment of the application may be discussed herein or shown in the drawings of one embodiment and not in other embodiments, it should be apparent that individual features of one embodiment may be combined with one or more features of another embodiment or features from a plurality of embodiments.

In addition to the specific embodiments claimed below, the application is also directed to other embodiments having any other possible combination of the dependent features claimed below and those disclosed above. As such, the particular features presented in the dependent claims and disclosed above can be combined with each other in other manners within the scope of the application such that the application should be recognized as also specifically directed to other embodiments having any other possible combinations. Thus, the foregoing description of specific embodiments of the application has been presented for purposes of illustration and description. It is not intended to be exhaustive or to limit the application to those embodiments disclosed.

The invention claimed is:

1. A reclosable fastener assembly comprising:

a fastener comprising a pair of interlocking plastic tracks including a first track having a male profile and a second track having a female profile, the fastener having a height and a width when the first track and the second track are interlocked;

a slider slidably mounted to the pair of plastic tracks for movement between a closed position and an open position; and at least one end stop located at an end of the fastener, the at least one end stop formed integrally from at least one of the first track and the second track, the at least one end stop having a wedge shape with a first end, a second end, and a lateral extent, the first end being proximate the fastener and having a height no greater than the height of the fastener, the at least one end stop having a decreasing height from the first end to the second end, and the lateral extent extending beyond the width of the fastener.

2. The reclosable fastener of claim 1, wherein the at least one end stop comprises a first end stop formed integrally from the first track and a second end stop formed integrally from the second track.

3. The reclosable fastener of claim 2, wherein the first end stop and the second end stop are free of a bond therebetween.

4. The reclosable fastener of claim 2, wherein the first end stop and the second end stop are bonded together.

5. The reclosable fastener of claim 1, wherein the at least one end stop comprises a single end stop formed integrally from both the first track and the second track.

6. The reclosable fastener of claim 1, wherein the height of the first end of the at least one end stop is less than the height of the fastener.

7. The reclosable fastener of claim 1, wherein the pair of interlocking plastic tracks define an axis and the lateral extent forms an angle up to about 15 degrees relative to the axis.

8. The reclosable fastener of claim 1, wherein the pair of interlocking tracks define an axis, and the end stop has an upper surface angled relative to the axis.

9. The reclosable fastener of claim 1, wherein the at least one end stop is formed by at least one of ultrasonic welding, cold forming, thermal forming and injection molding.

10. The reclosable fastener of claim 1, wherein the at least one end stop comprises at least one of high density polyethylene, cyclic olefin copolymer, and low density polyethylene.

11. A reclosable bag comprising:

first and second opposing body panels fixedly connected to each other along a pair of sides and a bottom bridging the pair of sides; and a reclosable fastener assembly extending along a mouth formed opposite the bottom, the fastener assembly comprising:

a fastener comprising a pair of interlocking plastic tracks including a first track having a male profile and a second track having a female profile, the fastener having a height and a thickness when the first track and the second track are interlocked;

a slider slidably mounted to the pair of plastic tracks for movement between a closed position and an open position; and at least one end stop located at an end of the fastener, the at least one end stop formed integrally from at least one of the first track and the second track, the at least one end stop having a wedge shape with a first end, a second end, and a lateral extent, the first end being proximate the fastener and having a height no greater than the height of the fastener, the at least one end stop having a decreasing height from the first end to the second end, and the lateral extent extending beyond the width of the fastener.

12. The reclosable bag of claim 11, wherein the at least one end stop comprises a first end stop formed integrally from the first track and a second end stop formed integrally from the second track.

13. The reclosable bag of claim 12, wherein first end stop and the second end stop are free of a bond therebetween.

14. The reclosable bag of claim 12, wherein the first end stop and the second end stop are bonded together.

15. The reclosable bag of claim 11, wherein the at least one end stop comprises a single end stop formed integrally from both the first track and the second track.

16. The reclosable bag of claim 11, wherein the height of the first end of the at least one end stop is less than the height of the fastener.

17. The reclosable bag of claim 11, wherein the pair of interlocking plastic tracks define an axis and the lateral extent forms an angle up to about 15 degrees relative to the axis.

18. The reclosable bag of claim 11, wherein the pair of interlocking tracks define an axis, and the end stop has an upper surface angled relative to the axis.

19. The reclosable bag of claim 11, wherein the at least one end stop is formed by at least one of ultrasonic welding, cold forming, thermal forming and injection molding.

20. The reclosable bag of claim 11, wherein the at least one end stop comprises at least one of high density polyethylene, cyclic olefin copolymer, and low density polyethylene.

21. A method of making a reclosable fastener assembly comprising:

providing a fastener comprising a pair of interlocking plastic tracks including a first track having a male profile and a second track having a female profile, the fastener having a height and a width when the first track and the second track are interlocked;

slidably mounting a slider to the pair of plastic tracks for movement between a closed position and an open position; and forming at least one end stop at an end of the fastener, the at least one end stop formed integrally from at least one of the first track and the second track, the at least one end stop having a wedge shape with a first end, a second end, and a lateral extent, the first end being proximate the fastener and having a height no greater than the height of the fastener, the at least one end stop having a decreasing height from the first end to the second end, and the lateral extent extending beyond the width of the fastener.

22. The method of claim 21, further comprising:

forming a further end stop from the at least one of the first track and the second track, the further end stop formed in line with and proximate to the at least one end stop, and separating the at least one end stop from the further end stop, the further end stop forming an end stop of a similarly configured fastener.

* * * * *